US007251914B1

(12) United States Patent
Petersen et al.

(10) Patent No.: US 7,251,914 B1
(45) Date of Patent: Aug. 7, 2007

(54) FRAME MOUNT LATCH ASSEMBLY FOR SUBSURFACE AIRCRAFT SERVICING PIT

(75) Inventors: Craig Petersen, Costa Mesa, CA (US); Eynon S. Johnson, Costa Mesa, CA (US)

(73) Assignee: Dabico, Inc., Costa Mesa, CA (US)

( * ) Notice: Subject to any disclaimer, the term of this patent is extended or adjusted under 35 U.S.C. 154(b) by 816 days.

(21) Appl. No.: 10/706,697

(22) Filed: Nov. 13, 2003

(51) Int. Cl.
*E02D 29/14* (2006.01)

(52) U.S. Cl. ..... 52/20; 52/167.6; 244/114 R

(58) Field of Classification Search ..... 52/169.6, 52/169.7, 169.8, 169.9, 3–4, 23, 20; 292/227, 292/228, 123, 127, 97, 221, 196; 244/114 R, 244/115, 116, 114 B; 70/168, 169; 49/136, 49/465; 220/484, 241, 242
See application file for complete search history.

(56) References Cited

U.S. PATENT DOCUMENTS

| | | | | |
|---|---|---|---|---|
| 1,151,986 | A | 8/1915 | Ackerman et al. | |
| 1,645,492 | A | 4/1927 | Vanderlip | |
| 1,822,165 | A | 9/1931 | Moore | |
| 1,923,481 | A * | 8/1933 | Ford | 220/484 |
| 1,931,850 | A | 10/1933 | Moore | |
| 2,009,132 | A * | 7/1935 | Gehris | 49/465 |
| 2,573,450 | A | 10/1951 | Kallas et al. | |
| 2,693,100 | A | 11/1954 | Wiegel | |
| 2,793,786 | A | 5/1957 | Walker | |
| 4,763,449 | A * | 8/1988 | Vigneron et al. | 52/20 |
| 4,952,160 | A | 8/1990 | Olsen | |
| 5,404,676 | A | 4/1995 | Devlin | |
| 5,465,826 | A | 11/1995 | Noestheden | |
| 5,465,862 | A * | 11/1995 | Devlin | 220/830 |
| 5,950,368 | A * | 9/1999 | Bradford | 52/20 |
| 6,199,414 | B1 * | 3/2001 | Chang | 70/168 |
| 6,715,715 | B1 * | 4/2004 | Petersen | 244/114 R |
| 6,749,363 | B1 * | 6/2004 | Petersen | 404/25 |
| 6,811,119 | B1 * | 11/2004 | Petersen et al. | 244/114 R |
| 6,866,442 | B1 * | 3/2005 | Petersen | 403/326 |
| 6,951,318 | B1 * | 10/2005 | Petersen et al. | 244/114 R |
| 6,957,927 | B1 * | 10/2005 | Petersen | 404/25 |

* cited by examiner

*Primary Examiner*—Jeanette E. Chapman
*Assistant Examiner*—Chi Q. Nguyen
(74) *Attorney, Agent, or Firm*—Cislo & Thomas LLP

(57) ABSTRACT

A subsurface aircraft servicing pit is provided with a hold down assembly that secures a pit lid mounting frame in position on a bearing seat at the top of a prefabricated pit enclosure. A frame mount latch ring is suspended in spaced relation beneath the underside of the pit lid mounting frame and inwardly from the walls of the pit enclosure. At least a pair of frame mount latches are provided on opposite sides of the pit. The latches have bases secured to the pit walls and hooks that extend over the top of the frame mount latch ring. The frame mount latches are constructed so as to exert a downward force on the frame mount latch ring, thus holding the peripheral margin of the pit lid mounting frame tightly against a peripheral bearing seat surrounding the pit opening. The necessary force exerted by the frame mount latches may be provided by a coil spring located within the structure of each frame mount latch.

20 Claims, 9 Drawing Sheets

FRAME MOUNT LATCH ASSEMBLY FOR SUBSURFACE AIRCRAFT SERVICING PIT

BACKGROUND OF THE INVENTION

1. Field of the Invention

The present invention relates to a latching or fastening mechanism for securing a pit lid mounting frame to a subsurface chamber for servicing aircraft.

2. Description of the Prior Art

At modern aircraft terminals the servicing of aircraft on the ground is often performed using subsurface pits, which frequently are prefabricated structures. Such aircraft servicing pits are installed at aircraft docking, fueling, and loading areas beneath the surface of the tarmac across which aircraft travel during docking and departure maneuvers. The pits forming subsurface chambers are typically constructed of fiberglass, steel, concrete, or aluminum. These pits are quite often constructed as complete enclosures with surrounding walls, a floor, and an access lid at the top seated within a frame disposed upon the bearing flange at the top of the prefabricated pit. When the lid is closed it lies substantially flush with the surface of the tarmac. Such pits are installed below the surface of loading and refueling aprons at aircraft terminals, remote parking locations, and aircraft maintenance bases.

The purpose of the pits is to allow ground support functions to be carried out from subsurface enclosures. These ground support functions include the provision of fuel, the provision of electricity to the aircraft while it is in the docking area, the provision of air for cooling the aircraft interior, the provision of pressurized air for starting the aircraft engines, and for other aircraft support activities on the ground. The use of subsurface pits eliminates the need for mobile trucks, carts, and other vehicles which are otherwise present in the loading area and which interfere with the arrival and departure of aircraft in the vicinity of a loading gate.

The use of subsurface pits also allows the provision of fuel, power, cooling and pressurized air, and other supplies from a central location. The necessary fluid supplies and electrical power can be generated or stored with a greater efficiency at a central location, as contrasted with mobile generating or supply vehicles.

The pits located below the aircraft terminal area house valves, junction boxes, cooling air terminations, and other terminal equipment that is temporarily connected to an aircraft that has been docked. Umbilical pipes and lines, otherwise housed within the pits, are withdrawn from them through hatches therein and are coupled to a docked aircraft to supply it with fuel, air for cooling the aircraft interior, pressurized air for starting the engines, and electrical power.

The pits are constructed with either hinged or totally removable lids that are set within mounting frames which are positioned atop the prefabricated pits. The pit lid is set within the pit lid mounting frame. The pit lid can be moved relative to the surrounding mounting frame between an open position allowing access to the interior of the pit and a closed position flush with the surfaces of the docking, loading, or refueling areas across which aircraft travel and beneath which the pit is buried.

The pit lid mounting frames are constructed with outer peripheral margins that rest upon peripheral bearing ledges formed at the upper extremities of the prefabricated pits. The peripheral bearing ledges of the prefabricated pits extend laterally outwardly from the mouths which serve as access openings at the tops of the pit enclosures.

Each peripheral bearing ledge typically includes an edge that is turned upwardly to form a surrounding rim. The prefabricated pit thereby forms a peripheral bearing seat to receive the mounting frame for a lid that is hinged or otherwise raised relative to the pit lid mounting frame so as to provide access to the interior of the pit. The pit lid mounting frame is set within the rim of the peripheral bearing ledge. The pit lid mounting frame bears downwardly and is supported by the horizontal surface of the peripheral bearing ledge located therebeneath.

In conventional practice hold down bolts are employed to attach the pit lid mounting frame to the peripheral bearing seat formed at the top of the fiberglass pit. These mounting bolts are installed from the top of the mounting frame and have threaded shanks that extend through internally threaded nuts that are molded into the underside of the structure of the peripheral seat of the prefabricated pit. The bolts are tightened to anchor the pit lid mounting frame to the prefabricated pit in a permanent or semipermanent fashion.

A resilient gasket is normally located in a channel formed in the undersurface of the peripheral margin of the pit lid mounting frame. Tightening of the bolts resiliently compresses the gasket so as to form a watertight seal that prevents rainwater, melted snow, and other surface water from leaking down into the pit enclosure between the edge of the pit lid mounting frame and the peripheral seat upon which it is disposed at the top of the buried pit.

One difficulty with this pit lid mounting frame attachment system is that the hold down bolts can bind up due to exposure to the elements. Once they are removed for any reason they are quite difficult to reinstall. This is because debris can collect in the internally tapped bolt holes. If these bolts are not properly reinstalled or otherwise secured they can become loose on the runway. Runway debris and other foreign objects on an aircraft loading apron can be sucked into the jet engines of an aircraft and create serious damage.

SUMMARY OF THE INVENTION

The present invention provides a system for fastening a pit lid mounting frame to the peripheral seat of the subsurface pit which eliminates the requirement for hold down bolts that are exposed to the elements. According to the system of the present invention the pit lid mounting frame is provided with an annular frame mount latch ring that is secured in a horizontal orientation depending beneath the undersurface of the pit lid mounting frame by bolts that are spaced periodically throughout the circumference of the frame mount latch ring. Since these bolts are located beneath the pit lid mounting frame and within the enclosure of the pit, they are protected from the elements.

At least a pair of spring-loaded frame mount latches are provided at opposing and laterally spaced locations within the enclosure of the pit just beneath the frame mount latch ring. These frame mount latches have tubular body portions with elbows at their lower extremities. These elbows are each attached at one end to the wall of the fiberglass pit by means of a latch base or mounting bracket. Wall spacers may be employed in this connection so that the tubular body portions of the frame mount latches are vertically oriented when attached and are located just within the enclosure of the frame mount latch ring.

The upper ends of the frame mount latches include hooks that can be twisted to extend outwardly toward the frame mount latch ring, and are configured to extend downwardly over the upper edge of the frame mount latch ring. Retraction members formed as part of the latches are provided to exert a downward force on the frame mount latch ring, thereby drawing downwardly on the pit lid mounting frame to press it tightly against the bearing seat. The retraction members are typically coil springs located within the tubular body portion of the frame mount latch. The hooks at the upper ends of the latches thereby secure the frame mount latch ring, and thus the pit lid mounting frame to the aircraft servicing pit, by exerting downward pressure on the frame mount latch ring. The frame mount latches thereby hold the pit lid mounting frame tightly against the peripheral seat provided at the upper extremity of the fiberglass pit.

The pit lid frame may easily be removed by overcoming the downwardly biasing force on the hooks provided by the internal springs within the frame mount latches. Removal is achieved by overcoming the bias of the spring end lifting the outer telescoping tubular portion of the frame mount latch relative to an inner portion located concentrically therewithin so as to lift the hooks high enough to clear the frame mount latch rings. The hooks are thereupon twisted about the axis of the tubular body portion so as to be redirected radially inwardly to provide clearance relative to the frame mount latch ring. The springs are then released. The pit lid frame, together with the frame mount latch ring can then be lifted from the pit lid mounting frame seat at the upper extremity of the fiberglass pit.

To replace a pit lid mounting frame the reverse procedure is followed. That is, the pit lid mounting frame is seated so that the frame mount latch ring resides just above the frame mount latches. The hooks of the latches are then pulled upwardly with the hooks directed radially inwardly toward the interior of the pit enclosure. The outer telescopic tubular portion of each frame mount latch is lifted, overcoming the opposing bias of the internal spring. The outer telescopic tubular portion of each latch is then twisted so that the hook thereof is then directed radially outwardly over the upper rim of the frame mount latch ring. When the outer tubular portion of the frame mount latch is released, the internal spring urges the hook downwardly to securely engage the upper rim of the frame mount latch ring and exert a downward force on it.

The frame mount latch assembly of the invention provides a system that permits faster replacement of a pit lid mounting frame for a subsurface aircraft servicing pit. Moreover, because the latch system is located entirely within the enclosure of the pit, it is not exposed to the elements and thereby deteriorates less rapidly. Moreover, even if the latches do become broken, their broken parts cannot result in foreign objects and debris that can be sucked into an aircraft engine, because they are located entirely within the confines of the pit.

In one broad aspect the present invention may be considered to be a frame mount assembly for a subsurface aircraft servicing pit having an upright pit wall enclosure atop which a bearing ledge surrounds an open pit access opining. The frame mount assembly is comprised of a pit lid mounting frame, a frame mount latch ring, and a plurality of frame mount latches. The pit lid mounting frame has an undersurface and an outer peripheral margin that seats upon the bearing ledge above the upright pit wall enclosure. The frame mount latch ring depends from the underside of the pit lid mounting frame and is located within the circumference of the upright pit wall enclosure. The frame mount latches have bases attached to the wall enclosure at spaced intervals from each other. They also have hooks that are extendable from the bases to a latching position engaging the frame mount latch ring at spaced locations thereon. The hooks are also retractable toward the bases to thereby force the peripheral margin of the pit lid mounting frame downwardly upon the bearing ledge, whereby the pit lid mounting frame bears down upon the bearing ledge with a force that exceeds gravitational force on the pit lid mounting frame.

Preferably, each latch is comprised of a resiliently deformed spring acting between the latch base and the latch hook. Each of the latches may be further comprised of a tubular spring guide. The spring is preferably a coil spring disposed within the tubular spring guide. The hook may be located at the upper end of the tubular spring guide. Concentrically within the tubular spring guide there is a disk-shaped retainer plate with a link extending therethrough formed as a rod and having a shank that extends through the coil spring. The retainer plate may be located above the coil spring and secured to the upper end of the link shank. The lower end of the tubular spring guide has an annular end plate with an opening at its center through which the shank of the link slides.

The coil spring is compressed to thereby bear against the retainer plate and against the spring guide end plate. The hook can be extended relative to the base by an upward tensile force exerted thereon to further compress the coil spring. This allows sufficient upward movement of the hook to engage the frame mount latch ring, whereupon the spring exerts a downward force on the frame mount latch ring.

The link of each frame mount latch is joined to the base thereof by a pivotal connector. Spacing members may be interposed between the frame mount latch bases and the wall structure so as to properly position the latches radially within the circumference of the frame mount latch ring. This allows the hooks to be oriented so as to be directed from the interior of the enclosure outwardly over the upper edge of the frame mount latch ring.

As with conventional pit lid mounting frames, an annular, resilient gasket may be interposed between the peripheral margin of the mounting frame and the bearing ledge of the prefabricated pit. Each of the frame mount latches includes a spring or other biasing member that exerts a compressive force on the pit lid mounting frame against the bearing ledge so that the gasket creates a watertight seal therebetween.

In another broad aspect the invention may be considered to be a frame mounting assembly for a subsurface aircraft servicing pit having at least one upright wall that forms a complete, laterally encircling enclosure to define a pit cavity therewithin. A peripheral bearing ledge is located atop and peripherally beyond the laterally encircling enclosure.

The invention is comprised of a pit lid mounting frame, a frame mount latch ring, and a plurality of latches. The pit lid mounting frame has an undersurface and a peripheral margin that rests upon the peripheral bearing ledge. The frame mount latch ring is rigidly secured to the pit lid mounting frame beneath the undersurface of the pit lid mounting frame and within the pit cavity and within the lateral confines of the laterally encircling enclosure. The latches have bases anchored to at least one upright wall at laterally separated locations thereon. The latches also have catches rotatably joined to the bases and have hooks thereon located remote from the bases. The hooks are releaseably engageable with the frame mount latch ring. The latches also include retracting elements for drawing the hooks toward the bases. In this manner the hooks are releaseably engageable with the frame mount latch ring. The retracting elements exert forces on the pit lid mounting frame through the hooks and the latch ring that press the peripheral margin of the pit lid mounting frame downwardly upon the bearing ledge.

The invention may also be considered to be a combination of a prefabricated aircraft servicing pit, a pit lid mounting frame, a frame mount latch ring, and a plurality of frame latches. The prefabricated aircraft servicing pit is buried beneath a surface across which aircraft travel when not airborne. The pit includes a laterally surrounding upright enclosing structure topped with a laterally outwardly projecting bearing ledge. The pit lid mounting frame has an underside and a peripheral flange that seats upon the bearing ledge. The frame mount latch ring is rigidly secured to the pit lid mounting frame beneath the underside thereof. The frame mount latch ring resides within the lateral confines of the upright enclosing structure. The frame latches are anchored at selected locations to the upright enclosing structure below the frame mount latch ring. The frame latches include hooks for engaging the frame mount latch ring and a releaseable retraction member for exerting a force between the hooks and the mount latch ring in one direction and the upright enclosing structure in an opposite direction. This draws the peripheral flange of the pit lid mounting frame down upon the outwardly projecting bearing ledge.

The invention may be described with greater clarity and particularity by reference to the accompanying drawings.

DESCRIPTION OF THE EMBODIMENT

Figure 1:
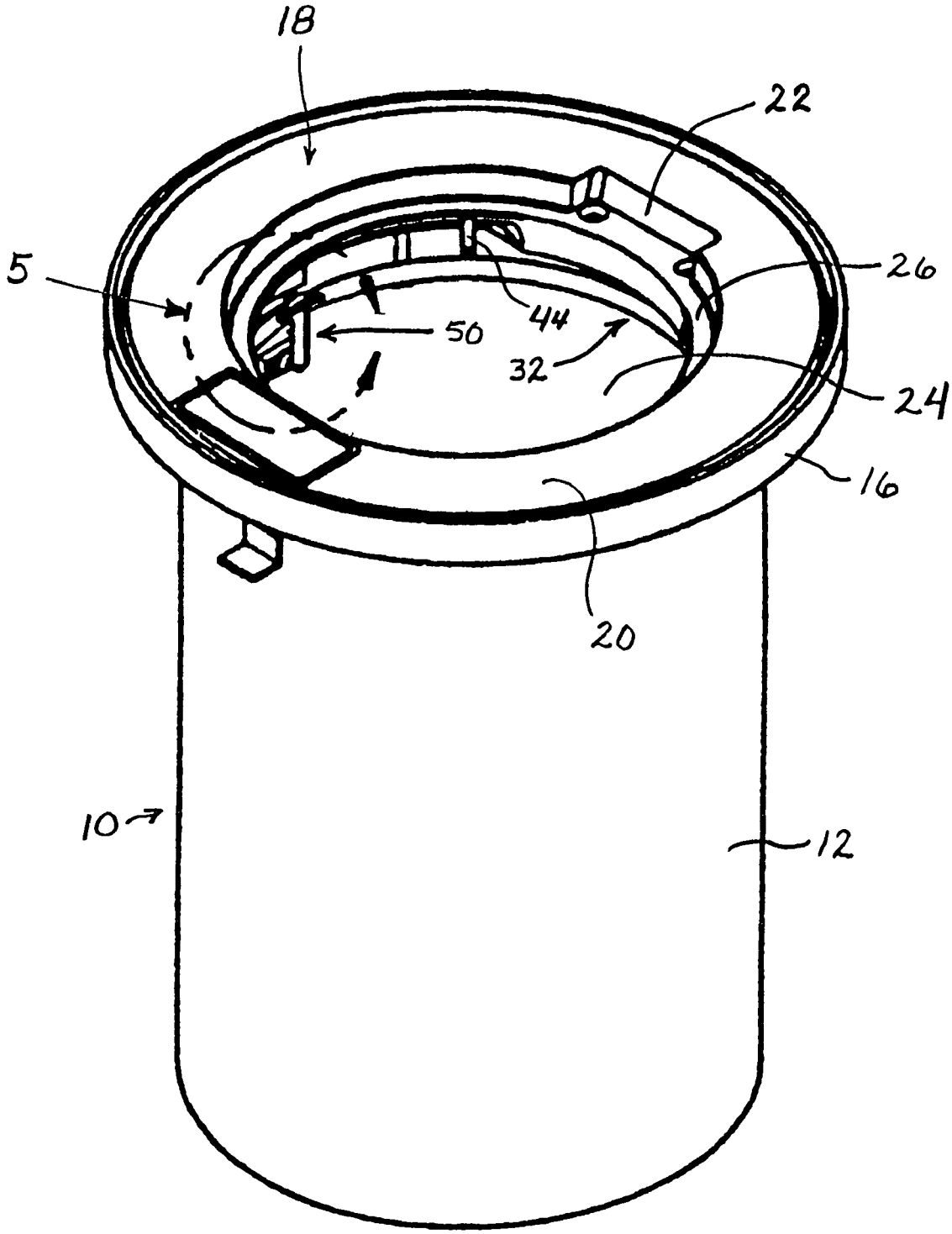
FIG. 1 is a perspective view of one embodiment of an aircraft servicing pit employing the frame mount latch assembly of the invention.

FIG. 1 illustrates a prefabricated, subsurface fiberglass aircraft servicing pit indicated generally at 10. The particular prefabricated aircraft servicing pit 10 illustrated has a cylindrical, annular configuration, although aircraft servicing pits of this type often have a generally rectilinear shape as well. The aircraft servicing pit 10 is designed to be buried beneath a surface across which aircraft travel when not airborne, such as a tarmac docking apron.

The aircraft servicing pit 10 has a laterally surrounding, cylindrical, annular upright side wall 12 which forms a laterally surrounding, upright enclosing structure. In aircraft servicing pits having a rectilinear shape there are four upright side walls which meet at slightly rounded right angle corners.

Figure 2:
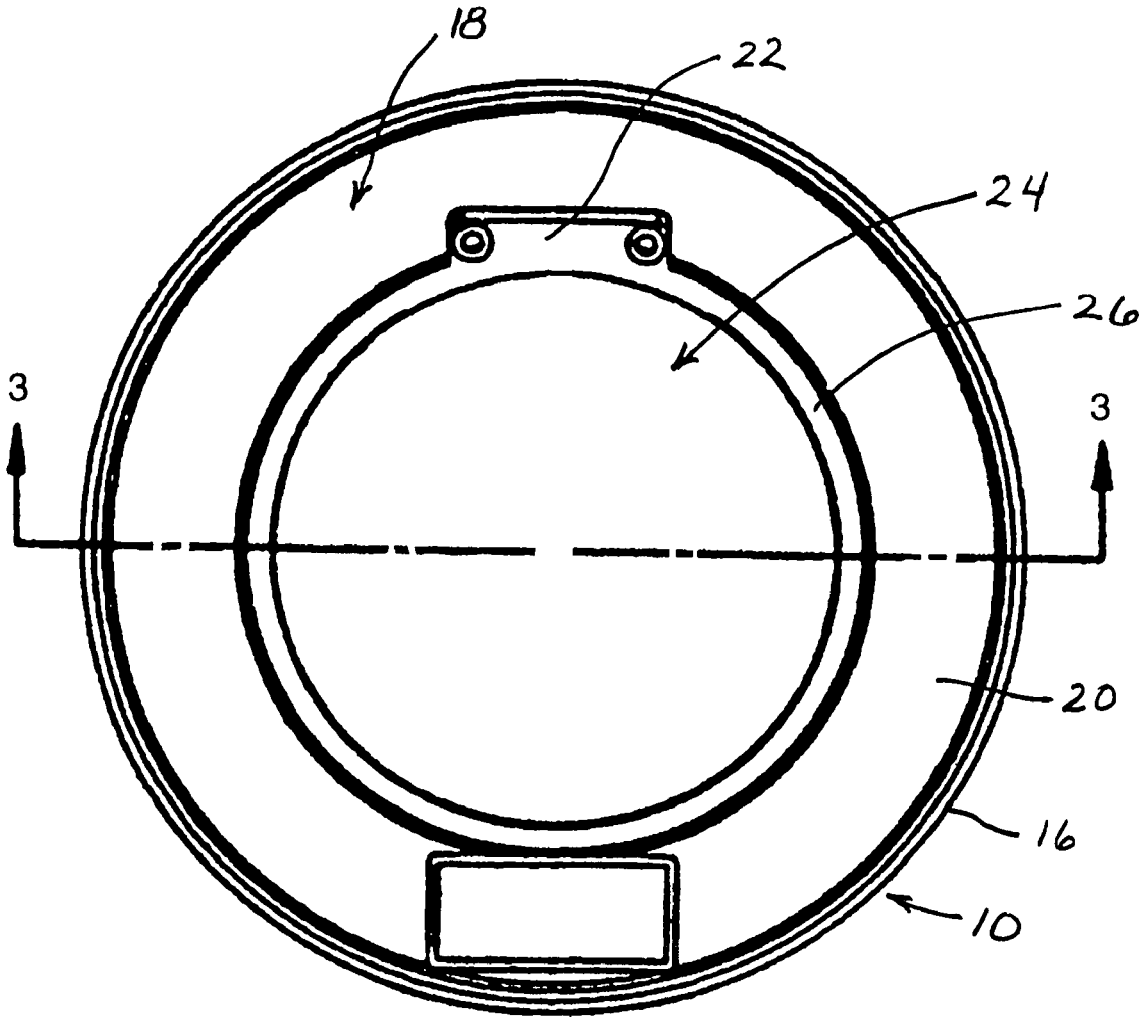
FIG. 2 is a top plan view of the aircraft servicing pit illustrated in FIG. 1.
Figure 3:
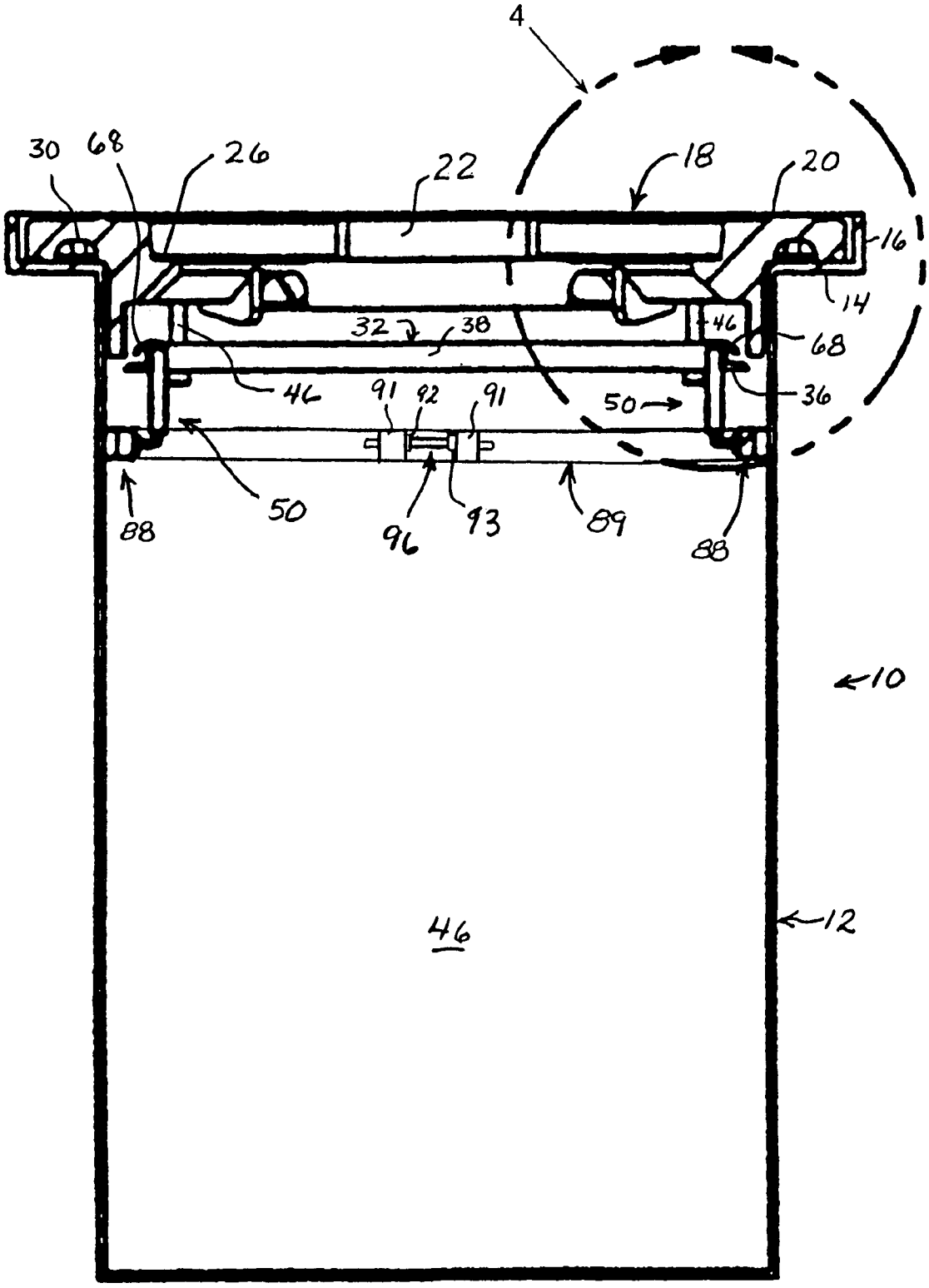
FIG. 3 is a sectional elevational view taken along the lines 3-3 of FIG. 2.
Figure 4:
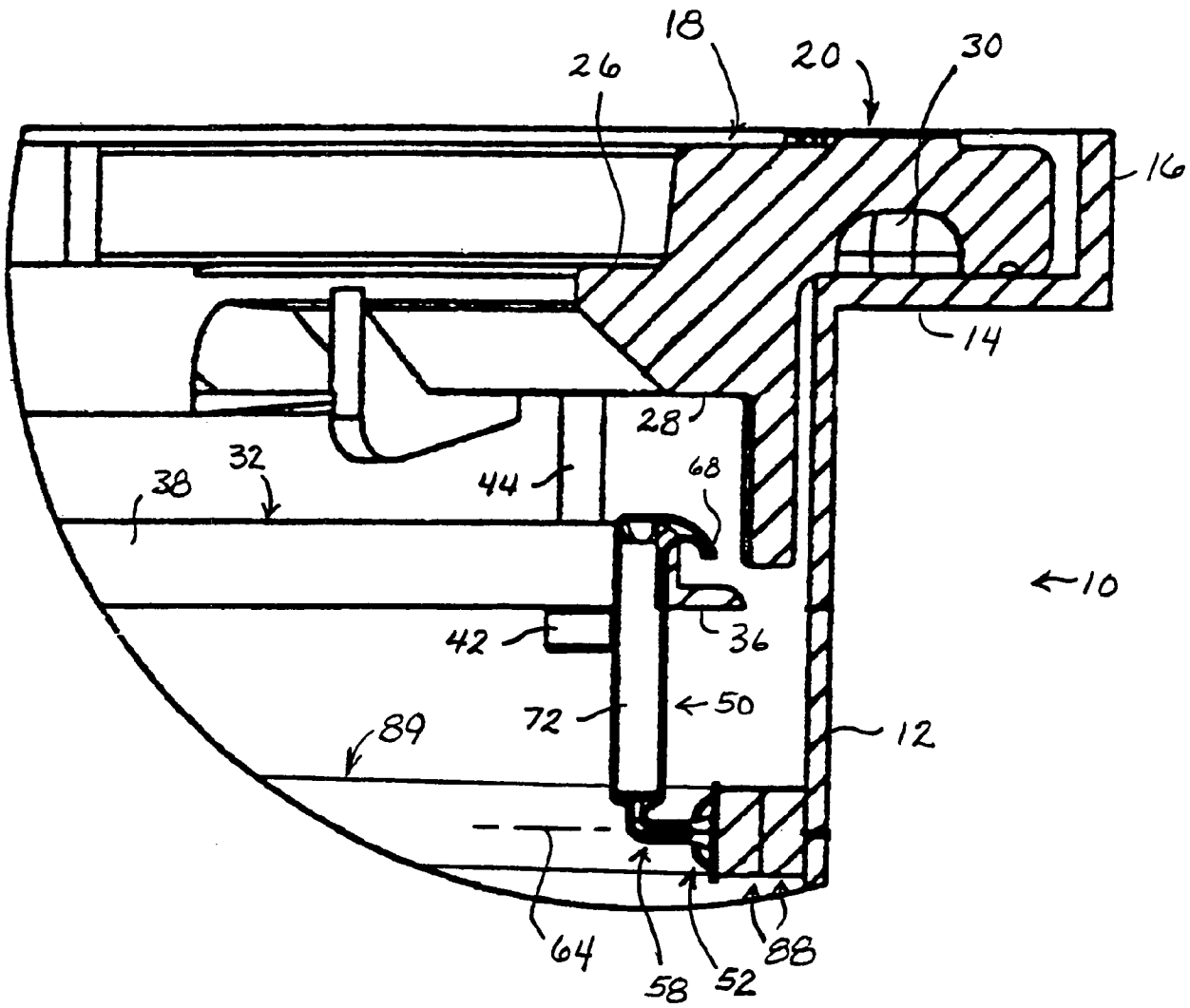
FIG. 4 is a sectional elevational detail indicated at 4 in FIG. 3.

The upright cylindrical wall 12 of the aircraft servicing pit 10 is topped with a laterally outwardly projecting bearing ledge 14, the peripheral edge extremity of which is turned upwardly to form a surrounding, upright outer rim 16, as shown in FIGS. 3 and 4. The bearing ledge 14 forms a peripheral seat for a generally annular pit lid mounting frame 18 having an outer peripheral margin 20 that seats upon the bearing ledge 14. A generally disk-shaped pit access lid is normally mounted in hinged arrangement with a hinge leaf projecting into the hinge pocket 22 of the pit lid mounting frame 18, visible in FIG. 2. The pit lid is rotated about a horizontal axis relative to the mounting frame 18 between an open position exposing the mouth 24 of the prefabricated pit 10 and a closed position seated upon the annular bearing ledge 26 of the pit lid mounting frame 18. Conventional aircraft servicing pits having pit lids of this type are fully illustrated in U.S. Pat. Nos. 5,404,676 and 5,465,826, hereby incorporated by reference in their entireties. However, the pit lid employed in the prefabricated aircraft servicing pit 10 is conventional and has been omitted from the drawings for clarity of illustration of the frame mount latch assembly of the invention.

An annular channel is defined in the undersurface 28 of the pit lid mounting frame 18 and a resilient, annular gasket 30 is disposed within this channel to form a surrounding moisture barrier to rainwater, melted snow, and other water and debris that might otherwise seep in between the peripheral rim 16 of the pit 10 and the outer edge of the pit lid mounting frame 18.

Figure 8:
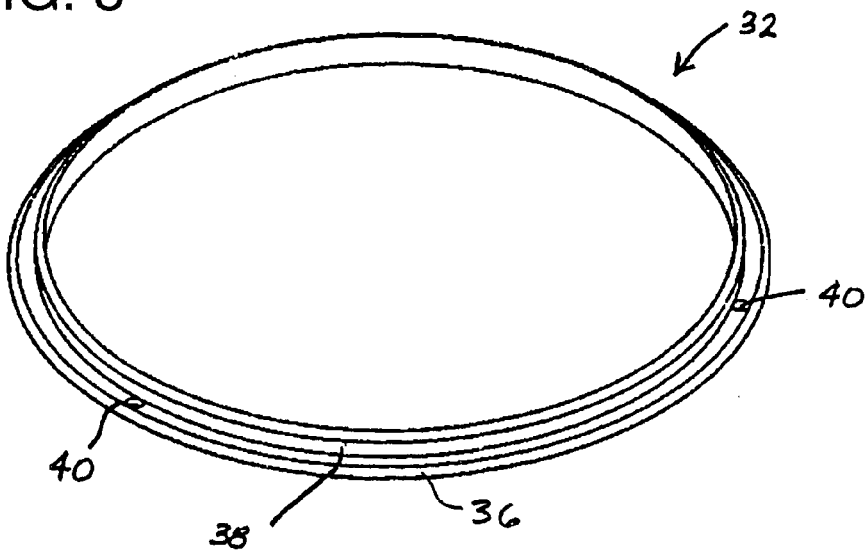
FIG. 8 is a perspective view of the frame mount latch ring illustrated in FIG. 6.
Figure 6:
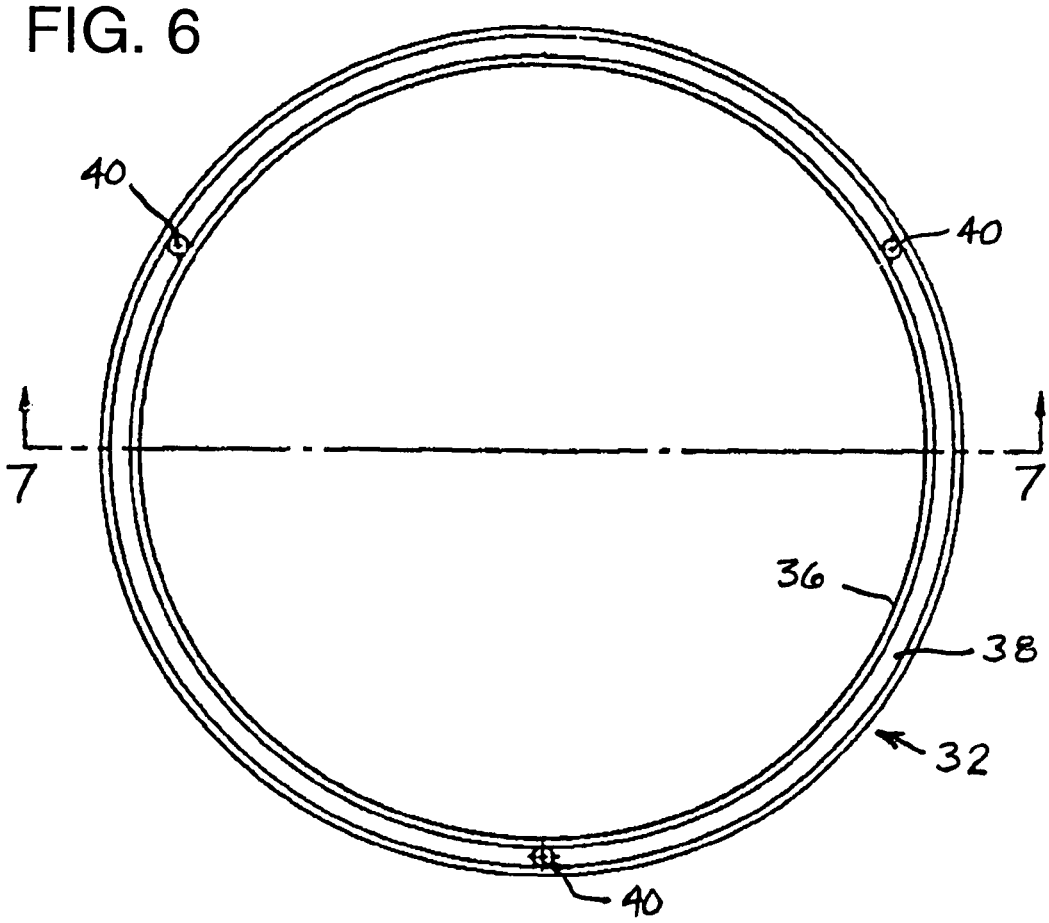
FIG. 6 is a top plan view of the frame mount latch ring employed in the embodiment of FIGS. 1-5, shown in isolation.
Figure 7:
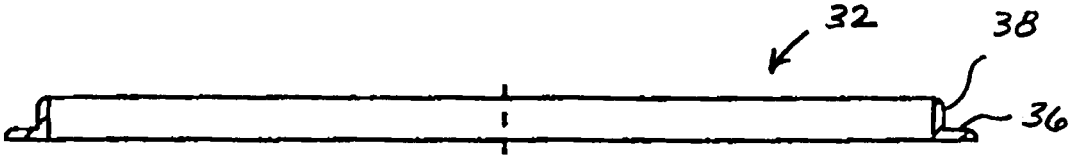
FIG. 7 is a sectional view taken along the lines 7-7 of FIG. 6.

The frame mount latch assembly of the invention employs a frame mount latch ring 32 which has a circular annular shape and is formed of angle-shaped steel stock having a radially outwardly projecting flange 36 and a vertically upwardly projecting flange 38. The direction "outwardly", as employed herein, refers to a direction proceeding radially outwardly in a horizontal direction from the axial center of the cylindrical pit side wall 12, while the direction "inwardly" refers to the opposite direction. The frame mount latch ring 32 is illustrated in isolation in FIGS. 6, 7, and 8.

The frame mount latch ring 32 has three mounting apertures 40 drilled in its radially outwardly projecting flange 36. The mounting apertures 40 are located one hundred twenty degrees apart from each other. The mounting apertures 40 receive the shanks 44 of mounting bolts 42 that are directed upwardly from beneath the frame mount latch ring 32. The heads of the mounting bolts 42 bear against the underside of the flange 36. The mounting bolts 42 form a screw socket set that supports the frame mount latch ring 32 in a horizontal orientation depending from the underside 28 of the pit lid mounting frame 18 at a location within the circumference of the surrounding cylindrical side wall 12. The frame mount latch ring 32 is thereby located within the enclosed cylindrical cavity 46 surrounded by the cylindrical annular side wall 12.

Figure 5:
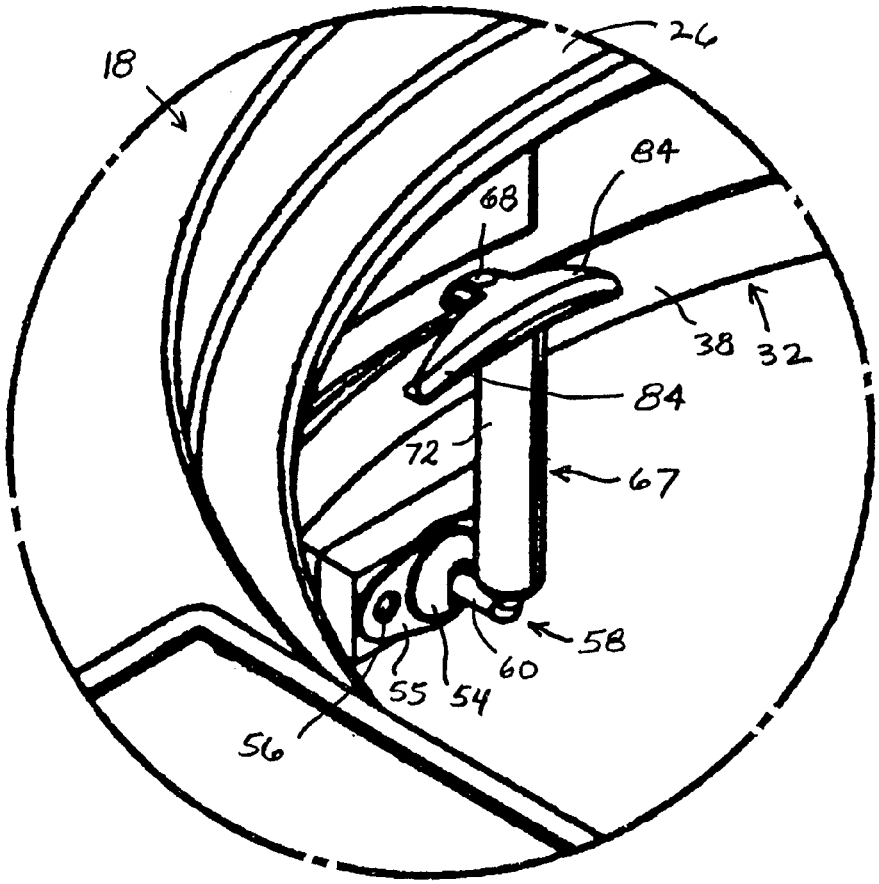
FIG. 5 is a perspective detail indicated at 5 in FIG. 1.

At least two frame mount latches 50 are employed to releaseably attach the pit lid mounting frame 18 in position upon the seat formed by the bearing ledge 14 of the prefabricated pit 10. In the embodiment illustrated a pair of frame mount latches 50 are employed and are located diametrically opposite each other within the enclosed cylindrical pit cavity 46, as illustrated in FIGS. 3 and 4. A single one of the frame mount latches 50 is visible in perspective in FIGS. 1 and 5, and is illustrated in greater detail in FIGS. 9, 10, and 12.

Figure 9:
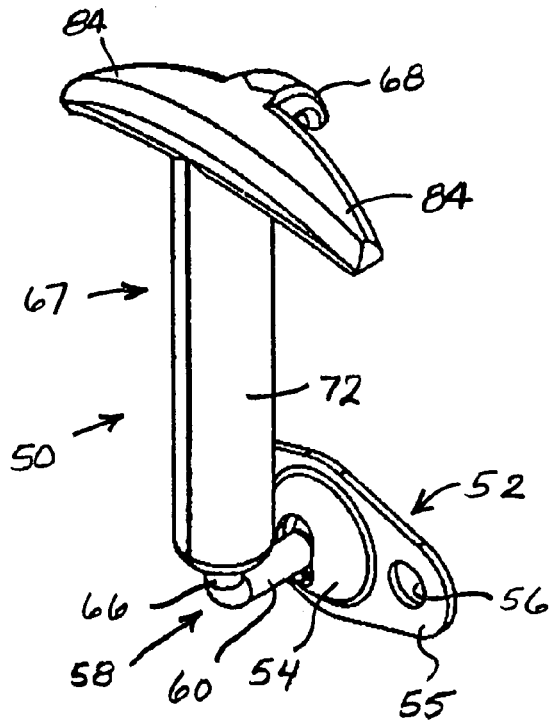
FIG. 9 is a perspective view of a single frame mount latch employed in the frame mount latch assembly of the invention, shown in isolation.
Figure 10:
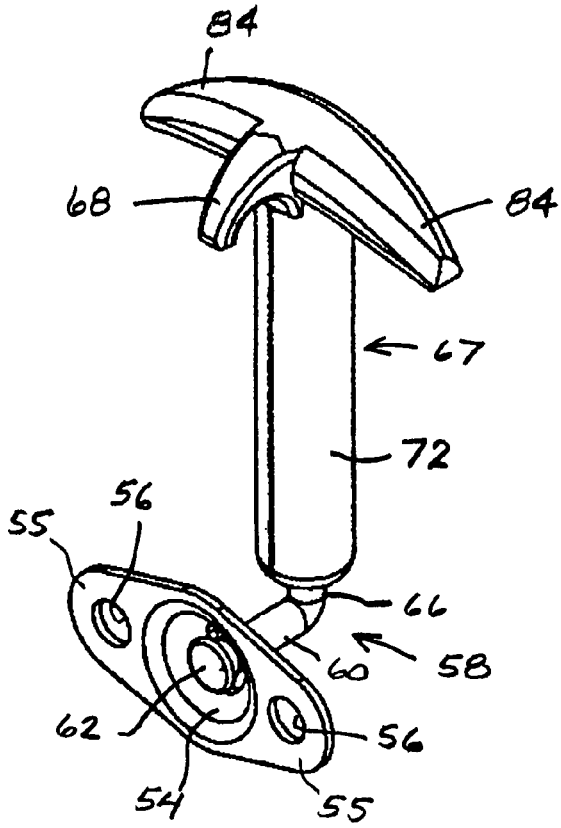
FIG. 10 is another perspective view of the frame mount latch of FIG. 9, viewed from a reverse direction.

Each of the frame mount latches 50 has a base 52 which defines a domed central portion 54 that is convex in an inward direction and concave in an outward direction, as best illustrated in FIGS. 9 and 10. Beside the domed portion 54 the base 52 has a pair of laterally projecting ears 55. A pair of mounting apertures 56 are defined in the ears 55 of the base 52 to receive screws (not shown) that attach the base 52 to the surrounding side wall 12.

Each of the frame mount latches 50 is also provided with an elbow 58 having a laterally directed leg 60 with an enlarged foot 62 that is captured within the domed portion 54 of the base 52. The elbow 58 is thereby rotatable about the laterally directed leg 60 about a generally horizontal axis of rotation indicated at 64 in FIGS. 3 and 4. The other leg 66 of the elbow 58 extends on as a rod oriented at right angles to the leg 60 and which serves as a link 75.

Figure 12:
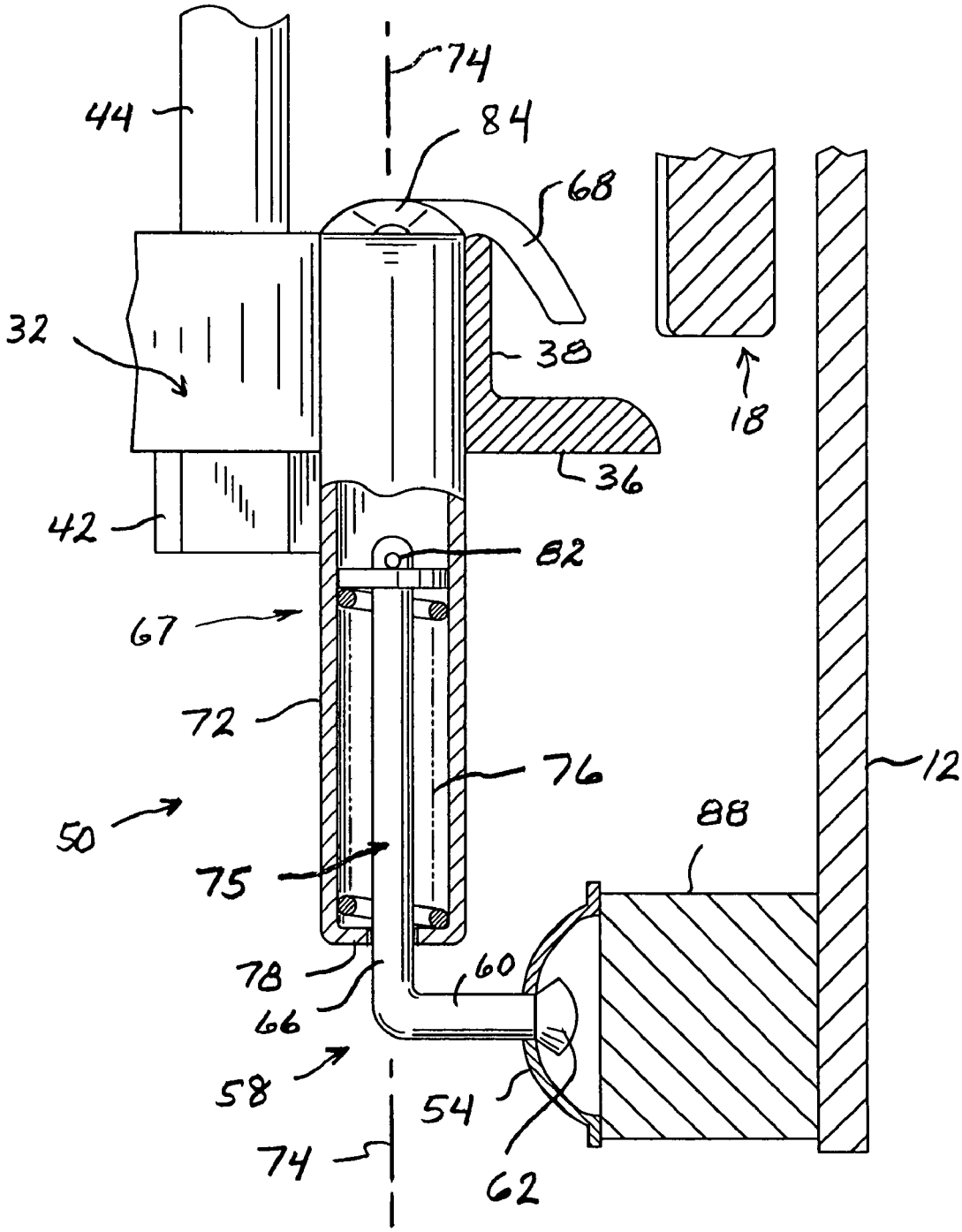
FIG. 12 is a sectional elevational view of the upper portion of a single one of the frame mount latches employed in the invention.

The operating mechanism of the frame mount latch 50 is illustrated in the sectional, elevational view of FIG. 12. As shown in that drawing figure the frame mount latch 50 has a catch 67 that has a hollow, cylindrical, annular, tubular guide body portion 72, which has a central, longitudinal axis 74. The catch 67 is equipped with a downwardly turned hook 68 at its closed upper extremity. A pair of downwardly turned finger grip wings 84 project laterally from the upper extremity of the catch 67 on both sides of the hook 68. At its lower end the catch 67 has an annular end plate 78 with a circular opening at its center.

The link 75 of the frame mount latch 50 has an elongated shank 70 which extends from the elbow 58 up through the central opening in the end plate 78 and up into the cylindrical, tubular spring guide 72. The aperture in the lower end plate 78 of the tubular spring guide 72 is large enough to admit the shank 70 of the link 75, which is actually an extension of the leg 66 of the elbow 58.

The releaseable retraction member employed in the embodiment of the invention illustrated is a resilient, compressed coil spring 76 that is disposed about the longitudinal shank 70 of the link 75. One end of the coil spring 76 bears against the outer periphery of the lower transverse end plate 78 of the spring guide 72. The central opening in the end plate 78 is of a reduced diameter that accommodates the sliding, reciprocal movement of the shank 70 of the link 75 therethrough. However, the lower end plate 78 also serves as a bearing support for the lower end of the spring 76 proximate the frame mount latch base 52.

At its upper extremity remote from the base 52 the shank 70 of the link 75 is provided with a transverse disk-shaped end retainer plate 80 held in position by a pin 82 that passes through a transverse aperture extending diametrically through the upper extremity of the shank 70. The coil spring 76 is held in a compressed condition exerting a force longitudinally along the longitudinal axis 74 of the guide body portion 72 against the lower end plate 78 of the spring guide body portion 72 in one direction, and an opposing longitudinally directed force exerted against the retainer plate 80 in the opposite direction along the axis 74. The opposing forces exerted against the end plate 78 and the bearing plate 80 tend to force these structures apart, thereby retracting the shank 70 into the tubular spring guide 72 and pulling the hook 68 down toward the base 52.

However, the hook 68 can be pulled in an opposite direction away from the base 52 by overcoming the spring bias of the spring 76 and compressing it further. The wings 84 of the catch 67 located on either side of the hook 68 can be engaged by two fingers of one hand and pulled upwardly to pull the catch 67 away from the base 52, thereby extending the shank 70 of the link 75 out of the tubular spring guide 72.

The catch 67 is completely rotatable relative to the link 75. Consequently, a user is able to use two fingers of one hand to pull upwardly upon the wings 84 of the catch 67 with the hook 68 directed inwardly toward the center of the pit cavity 46. Once the hook 68 has been pulled far enough away from the base 52 to clear the upper edge of the flange 38 of the frame mount latch ring 32, the catch 67 is rotated one hundred eighty degrees so that the hook 68 is directed outwardly, as illustrated in the drawing figures. The user then releases the wings 84 thus allowing the hook 68 to engage the upper edge of the leg 38 of the frame mount latch ring 32. The hooks 68 of the frame count latches 50 engage the frame mount latch ring 32 from above and are directed diametrically opposite each other, outwardly toward the surrounding, upright enclosing structure formed by the cylindrical side wall 12, as illustrated in FIG. 3.

The base 52 of each frame mount latch 50 is anchored to the upright enclosing structure of the cylindrical side wall 12 of the prefabricated pit 10. In some cases it is necessary to provide one or more spacer blocks 88, as illustrated in the drawing figures, so that the frame mount latches 50 are located far enough from the side wall 12 so that the tubular spring guides 72 both reside in an upright, generally vertical orientation when the hook 68 is engaged with the frame mount latch ring 32, as illustrated in FIG. 4. The spacing members 88 are interposed between the frame mount latch bases 52 and the wall enclosure formed by the cylindrical, vertical side wall 12. The spacer members 88 are employed to position the frame mount latches 50 just inwardly from the frame mount latch ring 32.

Figure 11:
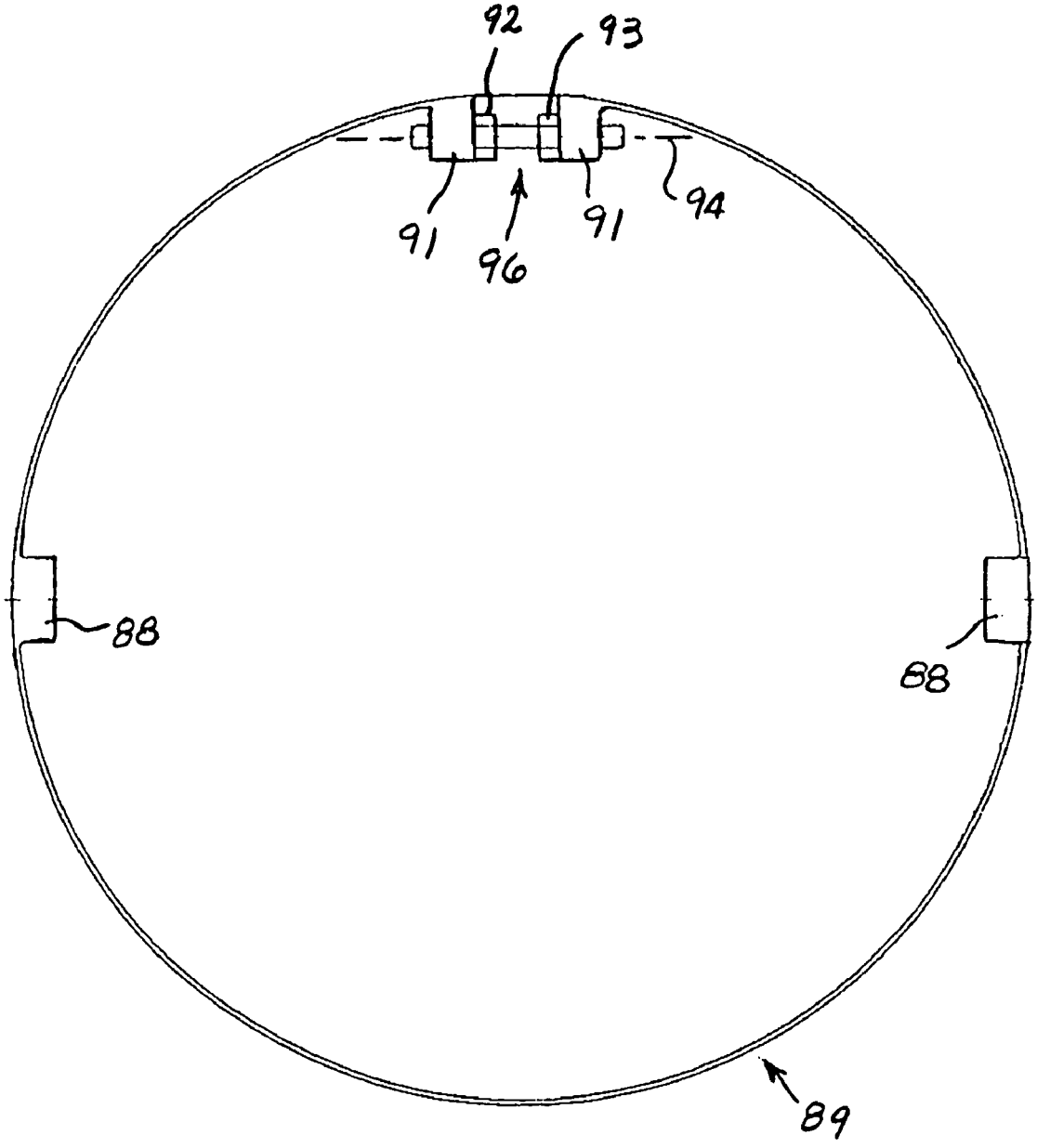
FIG. 11 is a top plan view of a spacer mounting expansion band employed in the embodiment shown.

Preferably, the spacers 88 are formed as inwardly directed projections carried on the inwardly facing side of an expansion band 89, illustrated in isolation in FIG. 11. The expansion band 89 is a large, arcuate metal band extending over an arc of three hundred sixty degrees, but having ends that separate from each other. Lugs 91 are located at the opposing ends of the band 89 and reside in close proximity to each other. The lugs 91 have bores defined therethrough which are coaxially aligned with each other when the expansion band 89 is expanded radially outwardly to press against the interior surface of the cylindrical subsurface pit wall 12.

Nuts 92 and 93 are welded to the mutually facing surfaces of the lugs 91. The nuts 92 and 93 have internally tapped apertures defined therethrough which reside in coaxial relationship along the expansion bolt axis 94, illustrated in FIG. 11. The apertures through the nuts 92 and 93 are internally tapped at the same pitch and diameter, but in opposite directions. That is, the aperture through the nut 92 is tapped with right-hand threads while the aperture through the nut 93 is tapped with left-hand threads. The opposing ends of an expansion stud 96 are respectively engaged in the tapped bores of the nuts 92 and 93.

To properly position the spacers 88, the expansion band 89 is positioned within the pit enclosure 46, at the appropriate elevation at which the bases 52 of the frame mount latches 50 are to be located. The curvature of the expansion band 89 conforms to that of the surface of the upright cylindrical pit side wall 12. The expansion band 89 is then adjusted within the pit cavity 45 in angular orientation. The expansion band 89 is moved until the spacers 88 are at diametrically opposed locations on the pit wall 12 where the frame mount latches 50 will not interfere with any equipment or hoses in the pit. The expansion stud 96 is then rotated so that the engagement of its opposing ends in the nuts 92 and 93 forces the lugs 91 apart from each other, thereby expanding the expansion band 89 radially outwardly to tightly press the expansion band 89 against the upright side all 12 and hold it securely immobilized relative thereto. The bases 52 of the frame mount latches are then anchored to the spacers 88 by screws through the apertures 56 in the ears 55. The bases 52 of the frame mount latches 50 are thereby immobilized relative to the upright side wall 12 of the aircraft servicing pit 10.

To install the pit lid mounting frame 18 on the bearing ledge 14 of the prefabricated pit 10, the frame mount latch ring 32 is first attached to the underside 28 of the pit lid mounting frame 18 by the bolts 42. This bolt arrangement holds the frame mount latch ring 32 suspended beneath the undersurface 28 of the pit lid mounting frame 18. The frame mount latches 50 are then secured to the pit side wall 12 by screws having shanks that extend through the apertures 56 in the wings 55 of the frame mount latch base 52. These screws extend into the structures of the spacers 88 which are immobilized relative to the upright wall 12 by the expansion band 89 as previously described. Spacer elements 88 are employed if appropriate, as illustrated in the drawings. Alternatively, however, the bases 52 of the frame mount latches 50 can be attached directly to the upright pit side wall 12.

The pit lid mounting frame 18 is then lowered into position so that its peripheral edge margin 20 rests atop the bearing ledge 14. In this position the frame mount latch ring 32 will reside within the pit cavity 46 spaced in an inwardly direction from the surrounding pit wall closure structure formed by the cylindrical side wall 12.

The catches 67 of the frame mount latches 50 will normally hang downwardly from the leg 60 of the elbow 58 due to the force of gravity, out of the way, while the pit lid mounting frame 18 is properly positioned. Once the pit lid mounting frame 18 is in position, the installer reaches down into the pit enclosure 46 and rotates the tubular spring guide tube 72 of each catch 67 upwardly about the generally horizontal axis 64 of the associated elbow leg 60. The hook 68 is directed inwardly into the cavity 46 and away from the cylindrical side wall 12.

The installer then pulls upwardly on the wings 84 from beneath, using two fingers of one hand until the hook 68 is above the upper edge of the leg 38 of the frame mount latch ring 32. The user then twists the catch 67 one hundred eighty degrees until the hook 68 is reversed in orientation and is directed radially outwardly, away from the center of the cavity 46. The installer then releases the wings 84, whereupon the force stored within the compressed coil spring 76 causes the spring 76 to expand, thereby exerting a tensile force through the hook 68 downwardly on the frame mount latch ring 32, and an opposing tensile force upwardly applied at the frame mount latch bases 52. The force is transferred to the side wall 12 by means of the frame mount latch bases 52, the spacers 88, and the expansion band 89, if spacers 88 are employed.

The force of the spring 76 is considerable, so that the peripheral edge margin 20 of the pit lid mounting frame 18 is pulled down with a sufficient force to resiliently compress the gasket 30 and ensure a liquid tight seal between the peripheral margin 20 of the pit lid mounting frame 18 and the bearing ledge 14. The gasket 30 thereby prevents water from leaking down into the pit enclosure 46.

As is evident from the drawings, the frame mount latch assembly of the invention is protected from the elements since the frame mount latch ring 32 and the frame mount latches 50 are totally enclosed within the pit cavity 46. Consequently, deterioration of these attachment devices is slowed so that failure is not likely to occur for many years. Moreover, even if there is a failure in one or both of the latches 50, all of the component parts will be confined within the pit enclosure 46, and cannot be sucked into the air intake of a jet aircraft or otherwise present a debris problem on the surface beneath which the prefabricated pit 10 is buried.

Undoubtedly, numerous variations and modifications of the invention will become readily apparent to those familiar with subsurface pit lid mounting frame latching mechanisms. Other types of releaseable tensioning members may be employed for exerting retracting forces between the hook 68 and the mount latch ring 32 in one direction and the upright enclosing structure of the pit wall 12 in an opposite direction. For example, a mechanical over-center, locking link arrangement may be employed to create the necessary downward force on the frame mount latch ring in place of a resilient spring mechanism. Accordingly, the scope of the invention should not be construed as limited to the specific embodiment depicted and described, but rather is defined in the claims appended hereto.

We claim:

1. A frame mount assembly for a subsurface aircraft servicing pit having an upright pit wall enclosure atop which a bearing ledge surrounds an open pit access opening comprising:

a pit lid mounting frame having an underside and an outer peripheral margin that seats upon said bearing ledge, a frame mount latch ring depending from said underside of said pit lid mounting frame and located within the circumference of said upright pit wall enclosure, and a plurality of frame mount latches having bases attached to said pit wall enclosure at spaced intervals from each other, and hooks that are extendable from said bases to a latching position engaging said frame mount latch ring at spaced locations thereon and said hooks are retractable toward said bases to thereby force said peripheral margin of said pit lid mounting frame downwardly upon said bearing ledge whereby said pit lid mounting frame bears down upon said bearing ledge with a force that exceeds gravitational force on said pit lid mounting frame.

2. A frame mount assembly according to claim 1 wherein each of said latches is comprised of a resiliently deformed spring acting between said base and said hook thereof.

3. A frame mount assembly according to claim 2 wherein each of said frame mount latches is further comprised of a tubular spring guide and said spring is a coil spring disposed within said tubular spring guide.

4. A frame mount assembly according to claim 3 wherein each of said latches further comprises a catch that includes said hook and a link which has a shank that extends through said coil spring and a retainer located on said shank, and said spring exerts opposing forces against said retainer and said tubular spring guide, and wherein said hook can be extended from said link by an upward force exerted thereon to resiliently deform said coil spring thereby allowing sufficient upward movement of said hook to engage said frame mount latch ring, whereupon said spring exerts a downward force on said frame mount latch ring.

5. A frame mount assembly according to claim 4 wherein said link of each frame mount latch is joined to said base thereof by a rotatable connector.

6. A frame mount assembly according to claim 1 further comprising spacing members interposed between said frame mount latch bases and said wall enclosure.

7. A frame mount assembly according to claim 1 further comprising an annular, resilient, gasket interposed between said peripheral margin of said mounting frame and said bearing ledge, and wherein each of said frame mount latches includes a biasing member that exerts a compressive force on said pit lid mounting frame against said bearing ledge to aid said gasket in creating a watertight seal between said peripheral margin of said mounting frame and said bearing ledge.

8. A frame mount assembly according to claim 1 wherein said upright wall enclosure has a cylindrical, annular shape.

9. A frame mount assembly for a subsurface aircraft servicing pit having at least one upright wall that forms a complete laterally encircling enclosure to define a pit cavity therewithin and having a peripheral bearing ledge located atop and peripherally beyond said laterally encircling enclosure, comprising:

a pit lid mounting frame having an undersurface and a peripheral margin that rests upon said peripheral bearing ledge, a frame mount latch ring secured to said pit lid mounting frame depending beneath said undersurface of said pit lid mounting frame and within said pit cavity within the lateral confines of said laterally encircling enclosure, and a plurality of latches having bases anchored to said at least one upright wall at laterally separated locations thereon and catches rotatably joined to said bases and having hooks thereon located remote from said bases and said hooks are releaseably engageable with said frame mount latch ring, and said latches include retracting elements for drawing said hooks toward said bases, whereby said hooks are releaseably engageable with said frame mount latch ring and said retracting elements exert forces on said pit lid mounting frame through said hooks and said latching ring that press said peripheral margin of said pit lid mounting frame downwardly upon said bearing ledge.

10. A frame mount assembly according to claim 9 wherein each of said retracting elements is comprised of a coil spring.

11. A frame mount assembly according to claim 9 wherein said coil spring is resiliently compressible.

12. A frame mount assembly according to claim 9 further comprising an elbow joining said catch to said base in each of said latches, and said elbow terminates in a foot captured by said base, whereby said elbow is rotatable relative to said base.

13. A frame mount assembly according to claim 9 wherein said catch in each of said latches is located inwardly from said frame mount latch ring and said hook thereof is directed outwardly from said catch to project outwardly over the top of said frame mount latch ring and engage said frame mount latch ring from above.

14. A frame mount assembly according to claim 13 wherein said at least one upright wall is cylindrical and further comprising latch spacers interposed between said latch bases and said cylindrical wall, and said frame mount latch ring is spaced inwardly from said cylindrical wall a uniform distance throughout its circumference.

15. A frame mount assembly according to claim 14 further comprising an expansion band and wherein said spacers are mounted upon said expansion band to project inwardly therefrom into said pit cavity, and said expansion band conforms to the surface of said cylindrical wall and is expandable outwardly against said cylindrical wall at a selected angular orientation within said laterally encircling enclosure.

16. In combination, a prefabricated aircraft servicing pit buried beneath a surface across which aircraft travel when not airborne and including a laterally surrounding upright enclosing structure topped with a laterally outwardly projecting bearing ledge, a pit lid mounting frame having an underside and a peripheral flange that seats upon said bearing ledge, a frame mount latch ring secured to said pit lid mounting frame beneath said underside thereof, and residing within the lateral confines of said upright enclosing structure, and a plurality of frame latches anchored at selected locations to said upright enclosing structure below said frame mount latch ring and including hooks for engaging said frame mount latch ring and a releaseable retraction member for exerting a force between said hooks and said mount latch ring in one direction and said upright enclosing structure in an opposite direction, thereby drawing said peripheral flange of said pit lid mounting frame down upon said outwardly projecting bearing ledge.

17. A combination according to claim 16 wherein said retraction member is a resilient coil spring.

18. A combination according to claim 16 wherein said hooks engage said frame mount latch ring from above and are directed outwardly toward said surrounding, upright enclosing structure.

19. A combination according to claim 16 further comprising latch spacers interposed between said frame latches and said upright enclosing structure to position said latches inwardly from said frame mount latch ring.

20. A combination according to claim 16 wherein each of said latches is comprised of a catch and a base, and an elbow having a laterally directed leg with a foot captured by said base and an opposite leg, whereby said base is anchored to said upright enclosing structure and said elbow is rotatable about said laterally directed leg relative to said base and said catch includes said hook and a tubular spring guide having a central axis and connected to said laterally directed leg of said elbow and said releaseable retraction member is a coil spring located within said spring guide, and said opposite leg of said elbow is a link formed with a longitudinal shank held concentrically within said spring, and said tubular guide is rotatable relative to said link about said central axis of said spring guide.

* * * * *